US007203445B2

(12) United States Patent
Uchida

(10) Patent No.: US 7,203,445 B2
(45) Date of Patent: Apr. 10, 2007

(54) LOCK MECHANISM, AND EXTERNAL APPARATUS AND IMAGE FORMING APPARATUS PROVIDED WITH THE SAME

(75) Inventor: Yasuhiro Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 10/874,259

(22) Filed: Jun. 24, 2004

(65) Prior Publication Data

US 2004/0264998 A1 Dec. 30, 2004

(30) Foreign Application Priority Data

Jun. 30, 2003 (JP) ..... 2003-187464

(51) Int. Cl.
*G03G 15/00* (2006.01)

(52) U.S. Cl. ..... 399/107; 292/113; 292/129

(58) Field of Classification Search ..... 399/107, 399/118, 124; 292/24, 95, 113, 129, 229, 292/DIG. 38, DIG. 49
See application file for complete search history.

(56) References Cited

U.S. PATENT DOCUMENTS 4,705,384 A * 11/1987 Mizutani et al. ..... 292/113
5,331,374 A 7/1994 Abe et al.
5,435,615 A * 7/1995 Schmitz ..... 292/113
5,583,612 A * 12/1996 Schell et al. ..... 399/107
5,781,823 A * 7/1998 Isobe et al.
5,802,426 A * 9/1998 Miyazaki et al. ..... 399/124
6,540,268 B2 * 4/2003 Pauser ..... 292/24
6,549,741 B2 * 4/2003 Miura ..... 399/124
6,763,211 B2 * 7/2004 Yokoyama ..... 399/124
6,775,515 B2 * 8/2004 Ouchi ..... 399/124
6,783,231 B1 * 8/2004 Kim ..... 399/124
6,968,143 B2 * 11/2005 Blair et al. ..... 399/124
6,973,279 B2 * 12/2005 Yokoi ..... 399/124
2003/0057634 A1 3/2003 Matsushima et al. ..... 271/117

FOREIGN PATENT DOCUMENTS

JP 5-84762 4/1993
JP 6-32470 2/1994

* cited by examiner

*Primary Examiner*—Susan Lee
(74) *Attorney, Agent, or Firm*—Fitzpatrick, Cella, Harper & Scinto

(57) ABSTRACT

A lock mechanism is provided with a lock member moved between a locking position for locking a first apparatus and a second apparatus, and a non-locking position for not locking the first apparatus and the second apparatus, and a restraining portion for restraining the lock member in the non-locking position. With an operation of bringing the second apparatus and the first apparatus close to each other from a state in which the first apparatus and the second apparatus are spaced apart from each other, the restraint of the lock member by the restraining portion is released, and the lock member is moved from the non-locking position to the locking position.

14 Claims, 13 Drawing Sheets

LOCK MECHANISM, AND EXTERNAL APPARATUS AND IMAGE FORMING APPARATUS PROVIDED WITH THE SAME

BACKGROUND OF THE INVENTION

1. Field of the Invention

The invention relates to a lock mechanism for locking a first apparatus and a second apparatus, an external apparatus provided with the same and connected to an image forming apparatus main body, and an image forming apparatus provided with the same.

2. Related Background Art

For example, there are many image forming apparatuses designed to permit the additional provision of a sheet feeding apparatus for making the sheet feeding capacity thereof large, an external discharging apparatus for increasing the discharged sheet stacking capacity, or an external apparatus' such as an original reading apparatus for increasing the function of the apparatus.

These external apparatuses are usually installed below or above an image forming apparatus main body, and it is often the case that a plurality of external apparatuses are usable in piles.

When these external apparatuses are connected to the image forming apparatus increases, and in order to secure the stability of the apparatus at this time, and to satisfy the standards of stability determined by Underwriters Laboratories (UL), Canadian Standards Association (CSA), etc., it is often necessary to couple the apparatuses together so as not to be spaced apart from each other. When the two apparatuses are thus to be coupled together so as not to be spaced apart from each other, the apparatuses have been coupled together as by a method of fixing the apparatuses by screws, as disclosed, for example, in Japanese Patent Application Laid-Open No. H06-032470 (page 3).

Also, as a construction for locking the apparatuses, there is a construction disclosed, for example, in Japanese Utility Model Application Laid-Open No. H05-084762. In a mechanism for locking the apparatuses with the door of an electronic apparatus, as disclosed in Japanese Utility Model Application Laid-Open No. H05-084762, a stopper is engaged with a pin, whereby the door is locked. When the door is to be opened, when an operator rotates the stopper, the stopper is restrained in a lock releasing position by a part (leaf spring) for maintaining a lock released state. In operative association with the operation of opening the door, the stopper is moved from the lock releasing position to a lock position.

In the apparatus for coupling the apparatuses together by the screws as disclosed in Japanese Patent Application Laid-Open No. H06-032470 (page 3), it is necessary to perform an operation such as screwing after the two apparatuses have been installed adjacent to each other. Consequently, the work for coupling the apparatuses together has been cumbersome. Also, when the apparatus main body is to be moved or the external apparatus is to be replaced with another one, it is necessary to release the mounting of the two apparatuses and space them apart from each other, but if the apparatuses are fixed by the screws or the like, the apparatuses cannot be easily detached from each other, and the working property has been bad.

Also, in a lock mechanism wherein the stopper is moved from the lock releasing position to the lock position in operative association with the operation of spacing the two apparatuses apart from each other (this is disclosed in Japanese Utility Model Application Laid-Open No. H05-084762), there is the problem that when the two apparatuses are spaced apart from each other, the stopper contacts with the pin to thereby hamper the spacing apart of the two apparatuses.

The embodiment shown in Japanese Utility Model Application Laid-Open No. H05-084762 is a form in which the door is pivotally moved about a shaft provided in the main body and therefore, the locus of the door when the door is opened is always substantially the same relative to the main body and thus, this problem is not remarkable. However, when an attempt is made to apply the lock mechanism of Japanese Utility Model Application Laid-Open No. H05-084762, for example, to a construction in which the two apparatuses are independent of each other, when one apparatus is to be spaced apart from the other apparatus, one apparatus may sometimes be spaced apart from the other apparatus in an inclined state with respect to the latter. In such a state, the timing at which the stopper being in the lock releasing position is moved away from the part for maintaining the lock released state to the lock position quickens, and the above-noted problem that the stopper contacts with the pin to thereby hamper the spacing apart of the two apparatuses becomes great. Further, in a case where in order to lock the two apparatuses reliably, a plurality of stoppers for locking are provided and the plurality of stoppers are moved as a unit, the above-noted problem becomes more remarkable.

SUMMARY OF THE INVENTION

The lock mechanism of the present invention for locking a first apparatus and a second apparatus has been made in order to solve the above-noted problem, and has:

a lock member movable between a first position for locking the first apparatus and the second apparatus, and a second position for not locking the first apparatus and the second apparatus; and a restraining portion for restraining the lock member in the second position, wherein with an operation of bringing the first apparatus and the second apparatus close to each other from a state in which the first apparatus and the second apparatus are spaced apart from each other, the restraint of the lock member by the restraining portion is released, and the lock member is moved from the second position to the first position.

DETAILED DESCRIPTION OF THE PREFERRED EMBODIMENTS

Some embodiments of the present invention will hereinafter be described with reference to the drawings.

Figure 1:
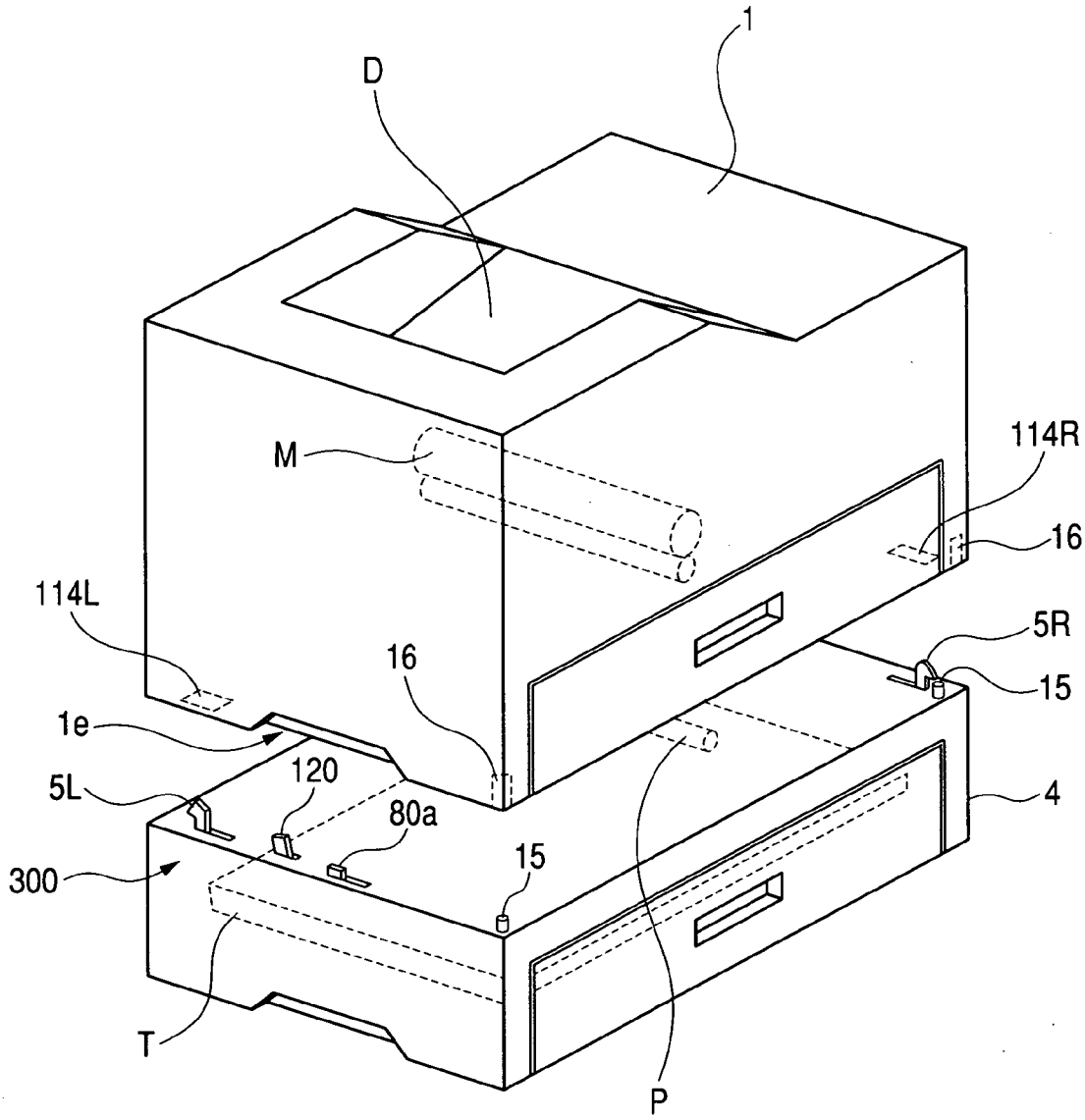
FIG. 1 is a perspective view showing an image forming apparatus main body and a sheet feeding apparatus.
Figure 2:
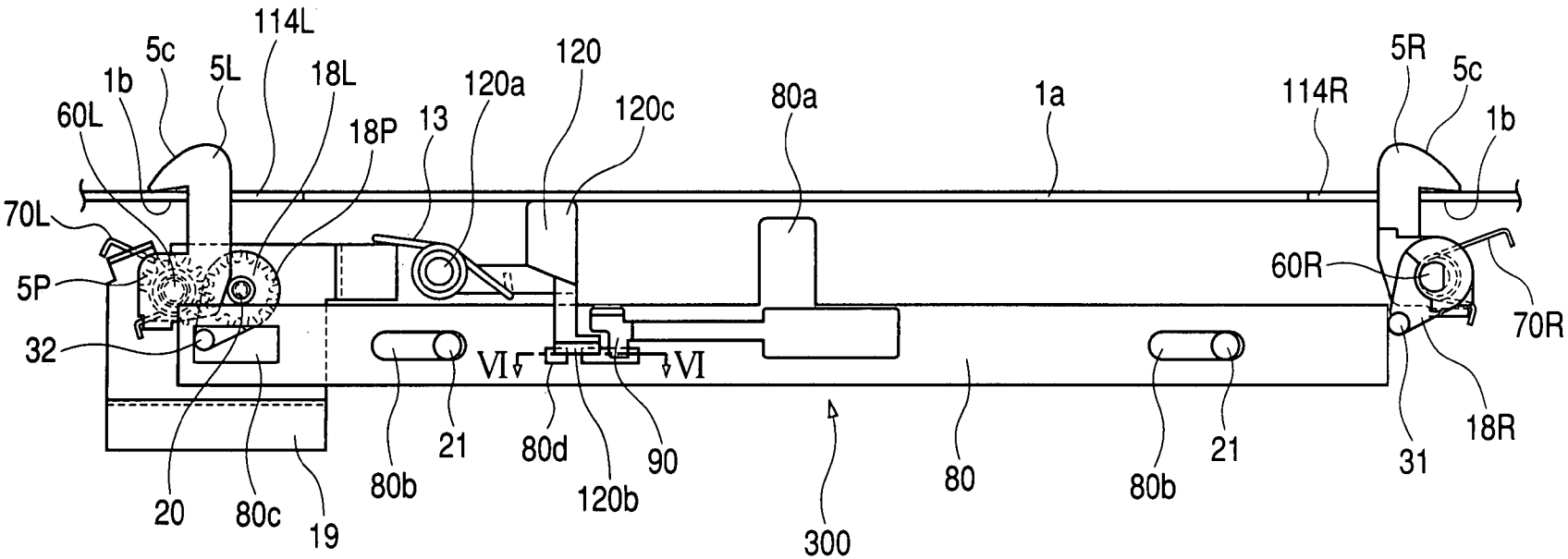
FIG. 2 is a cross-sectional view showing a lock mechanism.
Figure 3:
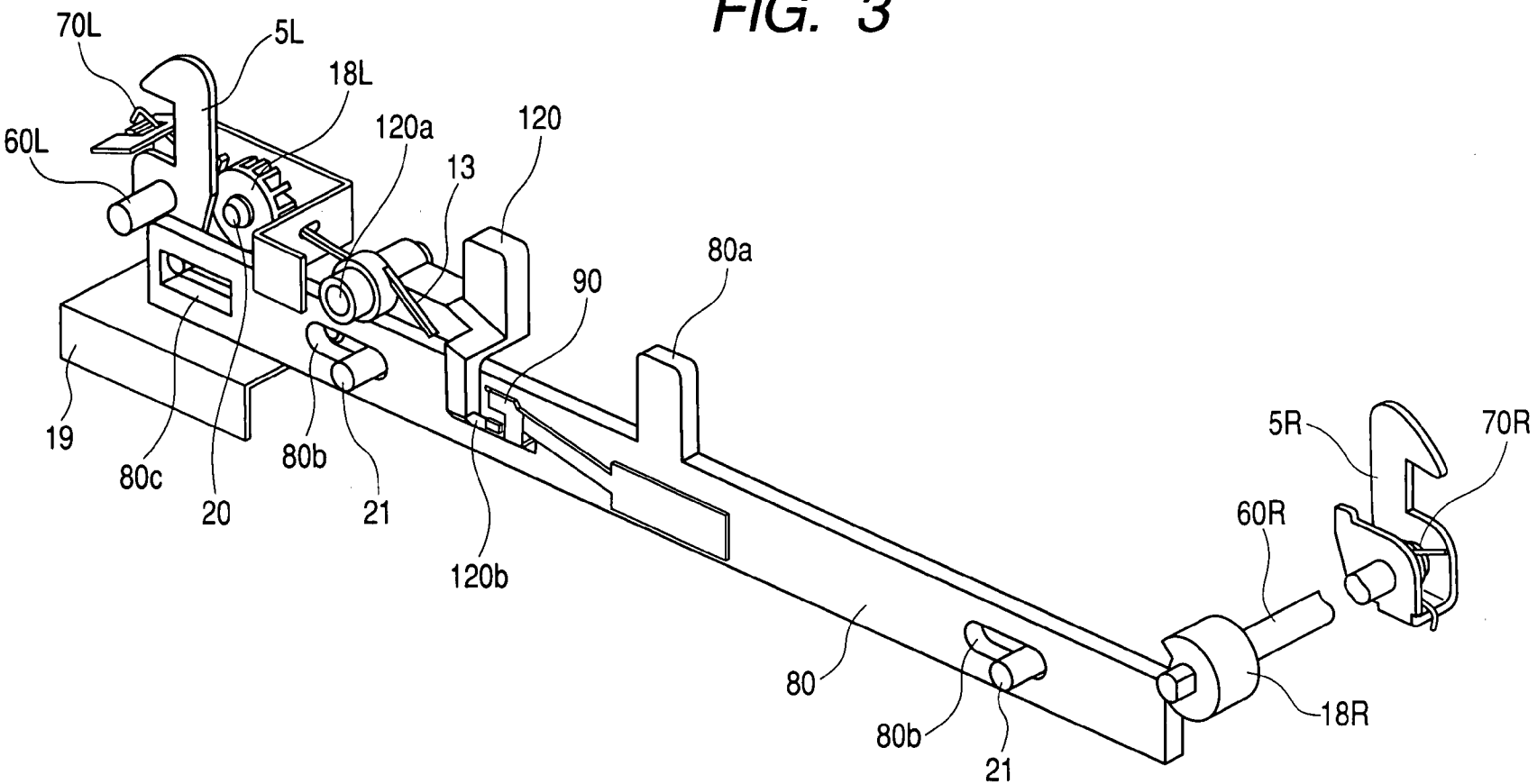
FIG. 3 is a perspective view showing the lock mechanism.

FIG. 1 is a perspective view showing the arrangement of a sheet feeding apparatus 4 as a second apparatus, an image forming apparatus main body as a first apparatus, and a lock mechanism 300 for locking the sheet feeding apparatus 4 and the image forming apparatus main body 1, FIG. 2 is a cross-sectional view showing the construction of the lock mechanism 300, and FIG. 3 is a perspective view of the lock mechanism 300, and all these figures show a state in which the sheet feeding apparatus 4 and the image forming apparatus main body 1 are locked by the lock mechanism 300.

As shown in FIG. 1, the sheet feeding apparatus 4 serving also as a supporting stand for the image forming apparatus main body 1 is disposed under the image forming apparatus main body 1. The sheet feeding apparatus 4 has a sheet feeding tray T for supporting thereon recording sheets on which images are to be formed by an image forming portion M provided in the image forming apparatus main body 1, and a pickup roller P which is sheet feeding means for feeding the sheets supported on the sheet feeding tray T. The sheets on which images have been formed are discharged onto a tray D.

On the sheet feeding apparatus 4, positioning pins 15 as the positioning means of the present invention are provided so as to protrude from the upper surface thereof which is a surface opposed to the image forming apparatus main body 1. On the other hand, the image forming apparatus main body 1 is formed with reference holes 16 into which the positioning pins 15 are inserted. When the image forming apparatus main body 1 is mounted on the sheet feeding apparatus 4, the image forming apparatus main body 1 is positioned by the reference holes 16, whereby the correct relative positional relation between the two apparatuses is ensured.

Latches 5L and 5R as the lock members of the present invention provided on the lock mechanism 300 are disposed at corners on the diagonal lines of the sheet feeding apparatus 4. The operating portion 80*a* of a lock lever 80 is disposed at a location on the upper surface of the sheet feeding apparatus 4 near a side thereof and substantially opposed to a hand placing portion 1*e* formed to raise the image forming apparatus main body 1, and has its position adjusted so that the operator can operate it from the hand placing portion 1*e*.

Also, an abutting lever 120 which is a restraint releasing member is disposed at a location whereat it abuts against the bottom surface 1*a* of the image forming apparatus main body 1 above it when the two apparatuses are coupled together.

The construction of the lock mechanism 300 will now be described with reference to FIGS. 2 and 3.

The lock lever 80 shown in FIG. 2 is formed with the operating portion 80*a* for the operator to operate, two slits 80*b*, an aperture 80*c* and a ratchet restraining portion 80*d* which is a portion engaged with a ratchet pawl 90 which will be described later. Lever shafts 21 fixed to the frame member of the sheet feeding apparatus 4 are inserted in the slits 80*b* of the lock lever 80, and the lock lever 80 is held for sliding in the left to right direction as viewed in FIG. 2 while being guided by the lever shafts 21.

Also, on the right side as viewed in FIG. 2, i.e., this side with respect to the drawing-out direction of the sheet cassette of the sheet feeding apparatus 4, a latch shaft 60R is rotatably held on the frame member of the sheet feeding apparatus 4. The latch 5R is fixed to one end of the latch shaft 60R, and a cam 18R is fixed to the other end of the latch shaft 60R. Also, the latch shaft 60R, the latch 5R and the cam 18R are biased in a clockwise direction as viewed in FIG. 2 by a torsion coil spring 70R which is biasing means having one end thereof restrained by the latch 5R, and a projection 31 formed integrally with the cam 18R abuts against the right end of the lock lever 80.

The latch 5L is held for rotation about a latch shaft 60L provided on a shaft holder 19 fixed to the frame member of the sheet feeding apparatus 4, and is biased in a counter-clockwise direction as viewed in FIG. 2 by a torsion coil spring 70L which is biasing means.

A pinion 5P is formed integrally with the latch 5L, and the pinion 5P is in meshing engagement with a pinion 18P formed-integrally with a cam 18L held for rotation about a holder shaft 20 provided on the shaft holder 19.

Also, the cam 18L is formed with a projection 32, and has its rotation regulated by the projection 32 abutting against the left end of the aperture 80*c* formed in the lock lever 80.

The ratchet pawl 90 as the restraining portion of the present invention is formed by a leaf spring having resiliency, and is fixed at a location whereat it can be opposed to the ratchet restraining hole 80*d* of the lock lever 80 of the frame member of the sheet feeding apparatus 4.

An abutting lever 120 as the restraint releasing portion of the present invention is held for rotation about an abutting lever shaft 120*a*, and is biased in the counter-clockwise direction by a torsion coil spring 13. The abutting lever 120 has an abutting portion 120*c* for abutting against the bottom surface 1*a* of the image forming apparatus main body, and when as shown in FIG. 2, the sheet feeding apparatus 4 is mounted on the image forming apparatus main body 1, the abutting portion 120*c* of the abutting lever 120 abuts against the image forming apparatus main body 1 and therefore, the abutting lever 120 is regulated in a predetermined position. Also, the abutting lever 120 is formed with a ratchet releasing portion 120*b* at a location opposed to the ratchet pawl 90.

In the state of FIG. 1, the latches 5L and 5R come into latch restraining holes 114L and 114R, respectively, formed in the bottom plate 1*a* of the image forming apparatus main body to thereby lock the image forming apparatus main body 1 and the sheet feeding apparatus 4. The positions of the latches 5L and 5R shown in FIG. 1 are the first position of the present invention.

Detailed description will now be made of the operation of the lock mechanism 300 resulting from the operation of mounting or dismounting the sheet feeding apparatus 4 with respect to the image forming apparatus main body 1.

Figure 4:
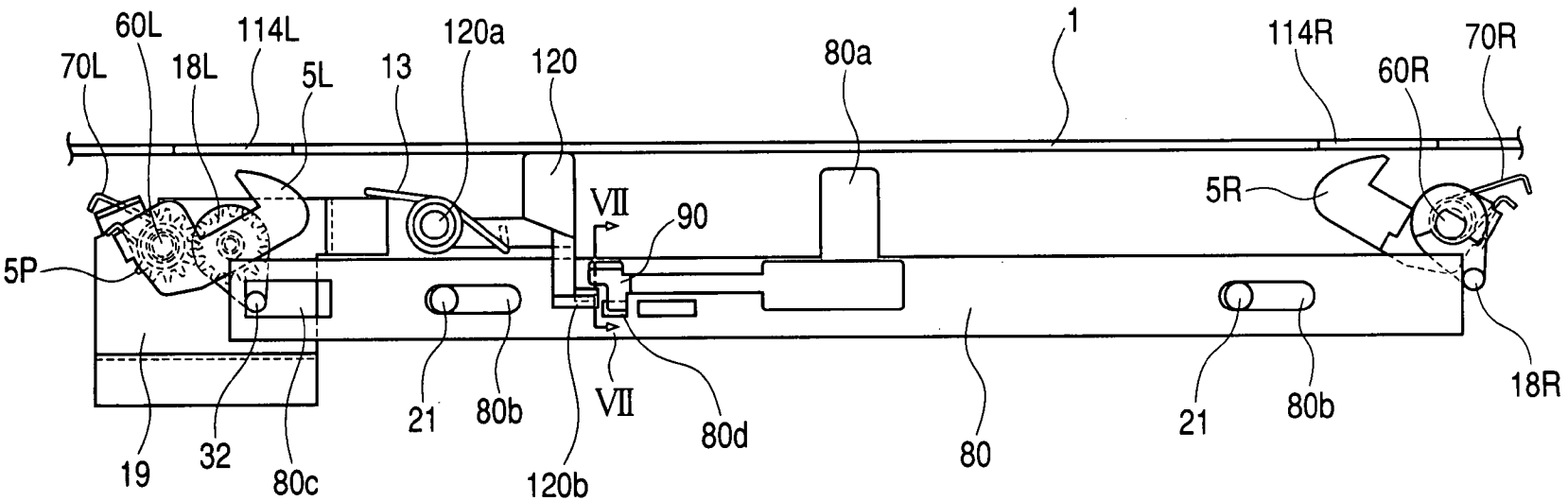
FIG. 4 is a cross-sectional view showing the lock mechanism.
Figure 5:
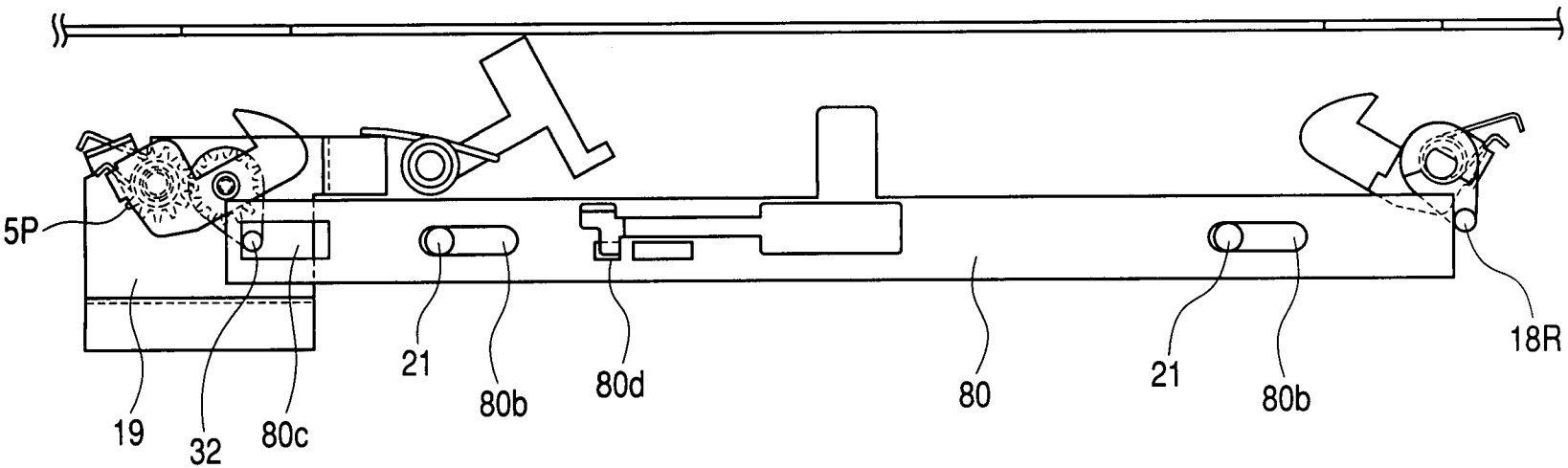
FIG. 5 is a cross-sectional view showing the lock mechanism.
Figure 6A:
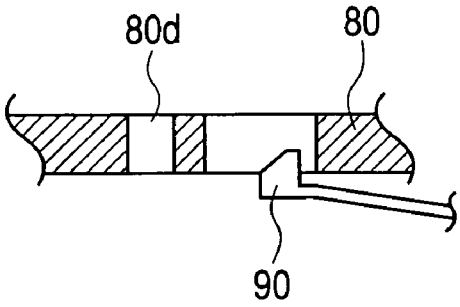
FIG. 6A is a cross-sectional view taken along line VI—VI in FIG. 2 in a state in which a ratchet pawl does not restrain a ratchet restraining hole.
Figure 6B:
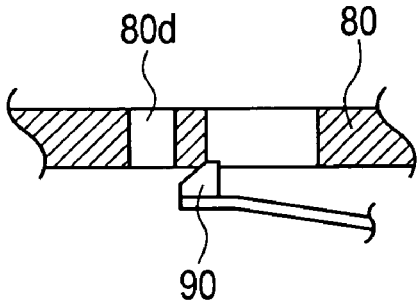
FIG. 6B is a cross-sectional view taken along line VI—VI in FIG. 2 in a state in which the ratchet pawl is flexed to enter the ratchet restraining hole.
Figure 6C:
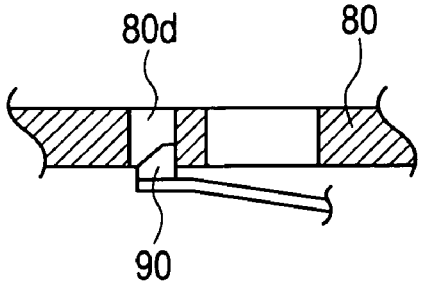
FIG. 6C is a cross-sectional view taken along line VI—VI in FIG. 2 in a state in which the ratchet pawl fits in the ratchet restraining hole to thereby restrain a lock releasing lever.

A method of releasing the lock mechanism 300 to thereby separate the apparatuses from each other will first be described with reference to FIGS. 4, 5 and 6A to 6C. FIG. 4 is a cross-sectional view showing the lock released state when the image forming apparatus main body 1 is placed on the sheet feeding apparatus 4, and FIG. 5 is a cross-sectional view showing the lock released state when the image forming apparatus main body 1 is spaced apart from the sheet feeding apparatus 4. FIGS. 6A to 6C are cross-sectional views taken along line VI—VI in FIG. 2 and showing the ratchet restraining hole 80*d* of the lock lever 80 and the ratchet pawl 90, FIG. 6A shows the state when the ratchet pawl 90 does not restrain the ratchet restraining hole 80*d*, FIG. 6B shows a state in which the ratchet pawl 90 is flexed to come into the ratchet restraining hole 80*d*, and FIG. 6C shows the state when the ratchet pawl 90 fits into the ratchet restraining hole 80*d* to thereby restrain the lock lever 80.

When the operating portion 80*d* formed on the lock lever 80 exposed to the hand placing portion 1*e* of the image forming apparatus main body 1 is slidden in the rightward direction as viewed in FIG. 2, the cam 18R and the cam 18L restrained by the lock lever 80 are rotated in the counter-clockwise direction about the latch shaft 60R and the holder shaft 20, respectively. Along therewith, the latch 5R coupled to the cam 18R through the latch shaft 60R is rotated in the counter-clockwise direction against the biasing force of the torsion coil spring 70R. Also, the pinion 18P of the cam 18L and the pinion 5P of the latch 5L are in meshing engagement with each other and therefore, by an operation toward the lock lever 80, the latch 5L is rotated in the clockwise direction about the latch shaft 60L against the biasing force of the torsion coil spring 70L. That is, when the operating portion 80*a* is operated to move the lock lever 80, the latch 5L and the latch 5R are moved as a unit.

At this time, as shown in FIG. 6B, the lock lever 80 once flexes the ratchet pawl 90, whereafter as shown in FIG. 6C, the ratchet pawl 90 is restrained in the ratchet restraining hole 80*d*. The lock lever 80 is restrained by the ratchet pawl 90, whereby the latches 5L and 5R are restrained in a second position in which they do not lock the image forming apparatus main body 1 and the sheet feeding apparatus 4. FIG. 4 shows a state in which the latches 5L and 5R are in the second position, and in this state, the engagement between the latches 5L, 5R and latch restraining holes 114L, 114R is released, and the two apparatuses become separable from each other.

Figure 7:
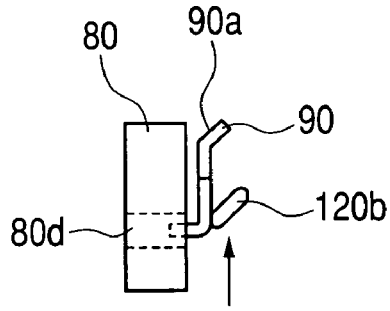
FIG. 7 is a cross-sectional view taken along line VII—VII in FIG. 4.
Figure 8:
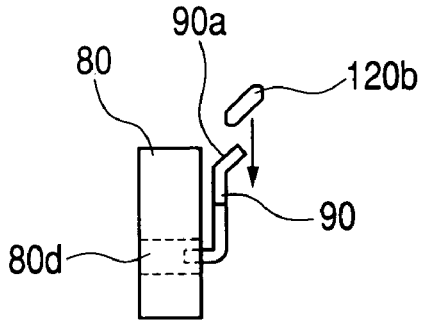
FIG. 8 is a cross-sectional view taken along line VII—VII in FIG. 4.
Figure 9:
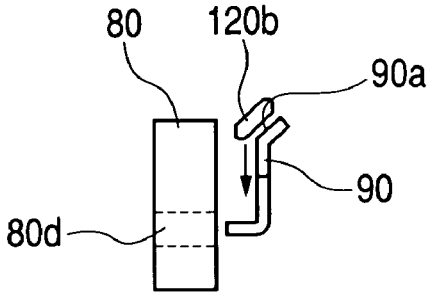
FIG. 9 is a cross-sectional view taken along line VII—VII in FIG. 4.

Reference is now had to FIGS. 7 to 9 to describe the operation and action of the abutting lever 120 resulting from the mounting and dismounting of the image forming apparatus main body 1 and the sheet feeding apparatus 4. FIGS. 7 to 9 are cross-sectional views taken along line VII—VII in FIG. 4.

When the image forming apparatus main body 1 is separated from the sheet feeding apparatus 4 with the latches 5R and 5L of the lock mechanism 300 released, the abutting lever 120 having so far abutted against the bottom plate 1*a* of the image forming apparatus main body 1 is spaced apart form the bottom surface of the image forming apparatus main body 1 and is pivotally moved in the counter-clockwise direction by the biasing force of the torsion coil spring 13 and assumes the state of FIG. 5. At this time, as shown in FIG. 7, the ratchet releasing portion 120*b* of the abutting lever 120 has its position and shape adjusted so as to pass the back side of the ratchet pawl 90 relative to the lock lever 80. Accordingly, in the operation of spacing the sheet feeding apparatus 4 apart from the image forming apparatus main body 1, it never happens that the engagement between the ratchet restraining portion 80*d* of the lock lever 80 and the ratchet pawl 90 is released. Consequently, it is possible for the latches 5R and 5L to reliably separate the two apparatuses from each other without being caught by the latch restraining holes 114R and 114L formed in the bottom plate 1*a* of the image forming apparatus main body 1.

When the image forming apparatus main body 1 is to be mounted on the sheet feeding apparatus 4, the abutting portion 120*c* of the abutting lever 120 abuts against the bottom surface of the image forming apparatus main body 1, and is rotated in the clockwise direction from the state of FIG. 5 against the biasing force of the torsion coil spring 13. At this time, as shown in FIG. 8, the ratchet releasing portion 120*b* of the abutting lever 120 has its shape adjusted so as to pass between the lock lever 80 and the ratchet pawl 90. When the ratchet releasing portion 120*b* passes between the lock lever 80 and the ratchet pawl 90, the ratchet releasing portion 120*b* abuts against the tapered surface 90*a* of the ratchet pawl 90, and the ratchet pawl 90 is flexed and moved by the ratchet releasing portion 120*b*. The ratchet pawl 90 is flexed in a direction away from the lock lever 80 by the ratchet releasing portion 120*b*, whereby the engagement between the ratchet restraining hole 80*d* of the lock lever 80 and the ratchet pawl 90 is released (see FIG. 9). By the biasing forces of the torsion coil springs 70L and 70R engaged by the two latches 5L and 5R, the latches 5L, 5R and the lock lever 80 are returned to their locked state shown in FIG. 2.

Accordingly, when the image forming apparatus main body 1 is to be placed on the sheet feeding apparatus 4, it becomes possible to reliably couple the two apparatuses together.

It is also possible to dispose a reference hole and a latch restraining hole at predetermined locations in the bottom surface of the sheet feeding apparatus 4 to thereby further provide a sheet feeding apparatus provided with a lock mechanism similar to that of the sheet feeding apparatus 4 under the sheet feeding apparatus 4.

In a case where with the image forming apparatus main body 1 and the sheet feeding apparatus 4 spaced apart from each other, the abutting lever 120 is held down by mistake, whereby the latches 5L and 5R are moved to a lock position, or in a case where the image forming apparatus main body 1 is brought close to the sheet feeding apparatus 4 while being obliquely inclined, and the latch 5L or the latch 5R is moved to the first position for locking before the latch restraining holes 114L and 114R of the image forming apparatus main body 1 sufficiently come close to the sheet feeding apparatus 4, the sheet feeding apparatus operates as follows the tapered surface of the inclined portion 5*c* of the latches 5R and 5L abuts against the abutting portion (underside) 1*b* of the bottom plate 1*a* of the image forming apparatus main body 1 and therefore, the latches 5R and 5L are once rotated in the counter-clockwise direction and the clockwise direction, respectively, as viewed in FIG. 2 against the biasing forces of the torsion coil springs 70R and 70L. Thereafter, the two apparatuses assume a desired positional relation, and at the same time, the two latches 5R and 5L are returned by the biasing forces of the torsion coil springs 70R and 70L and come into engagement with the latch restraining hole 114R and 114L, respectively, and the two apparatuses 1 and 4 become locked by the latches 5L and 5R (the state of FIG. 2).

In the lock mechanism according to the present embodiment, it becomes possible to effect the locking and lock releasing of the two apparatuses by a simple operation, and there can be realized a lock mechanism which is excellent in the working property and can accomplish reliable lock between the apparatuses.

The latches 5L, 5R, the ratchet pawl 90 for restraining the latches, and the abutting lever for releasing the ratchet pawl are all provided in the sheet feeding apparatus 4. In other words, if the latch restraining holes are formed on the image forming apparatus main body side, the lock with the image forming apparatus main body will become possible. Consequently, the cost of the image forming apparatus main body 1 can be suppressed. The sheet feeding apparatus is selectively mounted on the image forming apparatus main body, but an inexpensive apparatus can be provided to a user who does not need the sheet feeding apparatus, but needs the image forming apparatus main body 1 only.

As a construction for restraining the latches 5L and 5R in a position for not locking, there has been shown by way of example a construction having the latchet restraining holes 80*d* formed in the lock lever 80 moved integrally with the latches 5L and 5R and the ratchet pawl 90. However, a pawl as a restraining portion resiliently flexed may be provided on a member moved integrally with the latches 5L and 5R, and a blocking member for abutting against this pawl to thereby stop the movement of the latches may be provided in the sheet feeding apparatus. Again in this case, as in the already described construction, design can be made such that the pawl of the lock lever is moved so as to be flexed by the abutting lever moved with the mounting and dismounting of the image forming apparatus main body to thereby release the engagement between the pawl and the blocking member.

While a lock mechanism for locking the image forming apparatus main body and the sheet feeding apparatus has been shown as an embodiment, the lock mechanism described in the present embodiment is applicable as a mechanism for locking the two apparatuses together. For example, it can be applied to a mechanism for locking the image forming apparatus main body and an external apparatus (a reading apparatus or a discharging apparatus) which is an option.

(Other Embodiment)

Another embodiment of the lock mechanism will hereinafter be described with reference to FIGS. 10 to 15. In this embodiment, a lock mechanism for locking the image forming apparatus main body 1 as the first apparatus of the present invention and an original reading apparatus 2 as the second apparatus of the present invention mounted above the image forming apparatus main body 1 will be shown by way of example and described. The same members as those in the aforedescribed embodiment are given the same reference characters, and functionally similar members need not be described.

Figure 15:
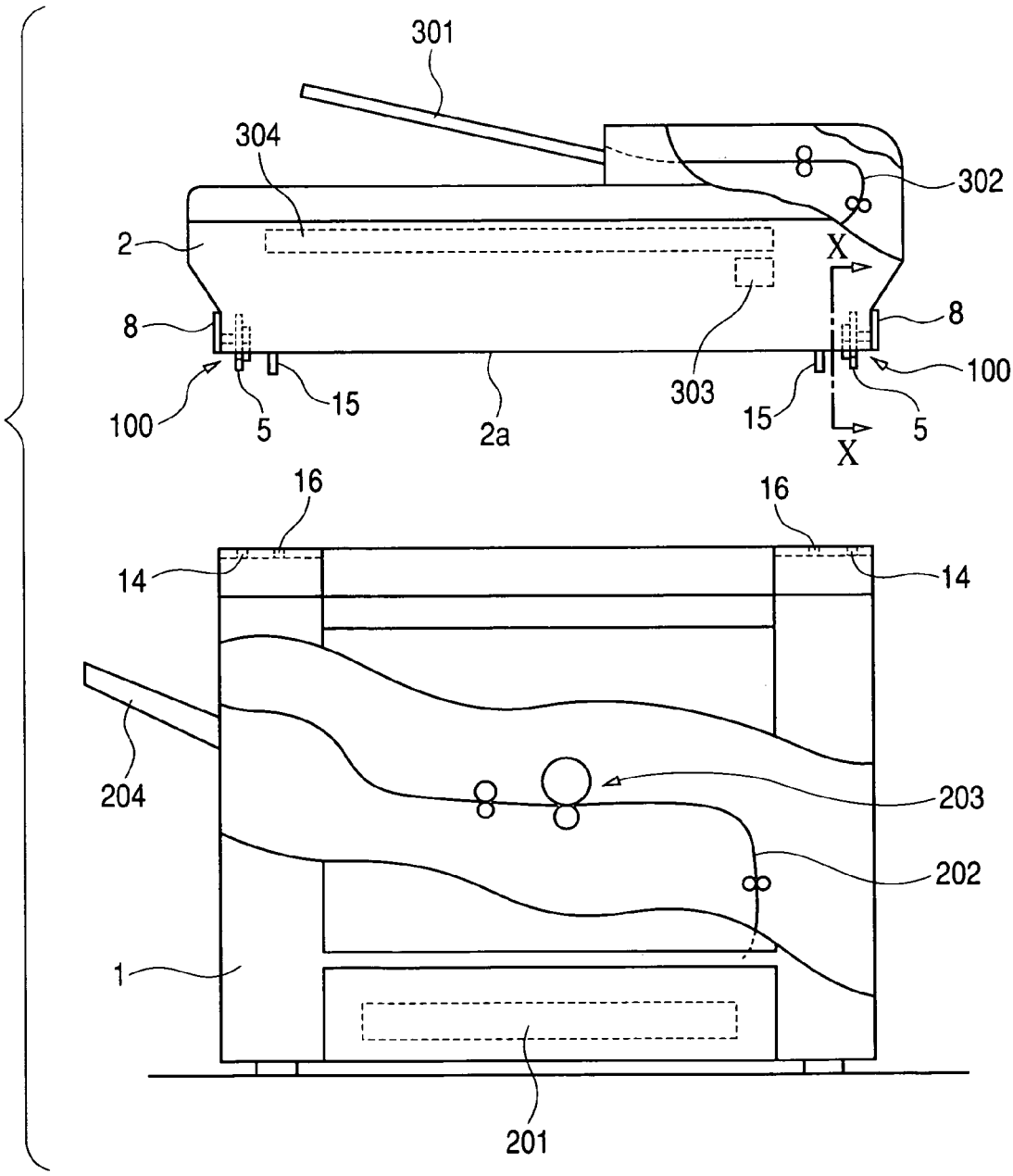
FIG. 15 is a front view showing an image forming apparatus main body and an original reading apparatus in another embodiment.

FIG. 15 is a partly cross-sectional view showing the general construction of the image forming apparatus main body 1 and the original reading apparatus 2. As shown in FIG. 15, on the lower opposite sides of the original reading apparatus 2, there are provided lock mechanisms 100 for hampering the spacing apart of the two apparatuses simply by the upper original reading apparatus 2 being placed on the upper portion of the lower image forming apparatus main body 1.

As shown in FIG. 15, the image forming apparatus main body 1 has a recording sheet tray 201 for supporting recording sheets thereon, and a recording sheet conveying path 202 for conveying the recording sheets supported on the recording sheet tray 201. Images are formed on the surfaces of the recording sheets conveyed by the recording sheet conveying path 202, by image forming means 203, and the recording sheets are successively discharged onto a recording sheet discharging tray 204.

The original reading apparatus 2 has an original tray 301 for supporting an original thereon, and an original conveying path 302 for conveying the original supported on the original tray 301. The information of the original conveyed by the original conveying path 302 or an original placed on a reading glass plate 304 is read by reading means 303.

Figure 10:
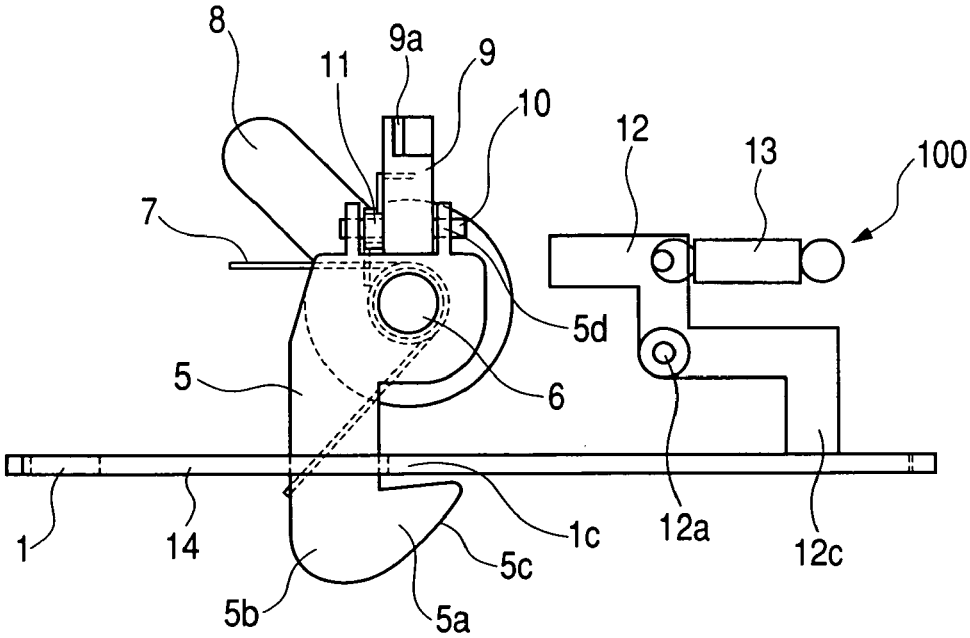
FIG. 10 is a cross-sectional view showing another embodiment of the lock mechanism.

FIG. 10 is a cross-sectional view of the lock mechanism 100 taken along line X—X in FIG. 15. FIG. 10 shows a state in which the original reading apparatus 2 is locked to the image forming apparatus main body 1. FIGS. 11, 12, 13 and 14 are perspective views showing the construction of the lock mechanism 100.

The lock mechanism 100 has a latch 5 as the lock member of the present invention fixed to an end portion of a latch shaft 6 pivotally movable relative to the frame member of the original reading apparatus 2. Also, a latch releasing lever 8 as the operating lever of the present invention is fixed to the other end of the latch shaft 6. Since the latch releasing lever 8 is exposed from the outer surface of the original reading apparatus 2 as shown in FIG. 15, the operator can operate the latch releasing lever 8. Further, a torsion coil spring 7 which is the biasing means of the present invention having one end thereof fixed to the frame member of the original reading apparatus 2 is engaged with the latch 5, and the latch 5, the latch shaft 6 and the latch releasing lever 8 are biased to a position as shown in FIG. 10 wherein the image forming apparatus main body 1 and the original reading apparatus 2 are locked by the latch 5, by the torsion coil spring 7.

The latch 5 has a lock portion 5*a* and an inclined surface portion 5*c* protruding from the base 5*b* of the latch 5. When the image forming apparatus main body 1 as shown in FIG. 10 is mounted on the original reading apparatus 2, the latch 5 is inserted into the latch restraining hole 14 of the image forming apparatus main body 1, and the lock portion 5*a* of the latch 5 and the underside of the engagement portion 1*c* of the image forming apparatus main body 1 come into engagement with each other, and the image forming apparatus main body 1 and the original reading apparatus 2 are locked. The position of the latch 5 shown in FIG. 10 wherein the image forming apparatus main body 1 and the original reading apparatus 2 can be locked is the first position of the present invention.

A holder 9 having a projected portion 9*a* is provided at a location on the latch 5 substantially opposite to the lock portion 5*a*. The holder 9 is mounted on a shaft 10 supported by a bearing 5*d* formed on the latch 5. The holder 9 is held for pivotal movement about the shaft 10 while being biased by a torsion coil spring 11.

An abutting lever 12 as the restraint releasing member of the present invention is provided near the latch 5, and is held on the frame member of the original reading apparatus 2 for pivotal movement about an abutting lever shaft 12*a*. The abutting lever 12 has a pawl 12*b* as a restraining portion engageable with the projected portion 9*a*, and an abutting portion 12*c* capable of abutting against the image forming apparatus main body 1. The abutting lever 12 is biased in the clockwise direction as viewed in FIG. 10 by a coil spring 13, but when as shown in FIG. 10, the original reading apparatus 2 is mounted on the image forming apparatus main body 1, the abutting portion 12*c* of the abutting lever 12 abuts against the image forming apparatus main body 1 and therefore, the pivotal movement of the abutting lever 12 is regulated.

Detailed description will now be made of the operation of the lock mechanism 100 resulting from the operation of mounting the original reading apparatus 2 on the image forming apparatus main body 1.

Figure 11:
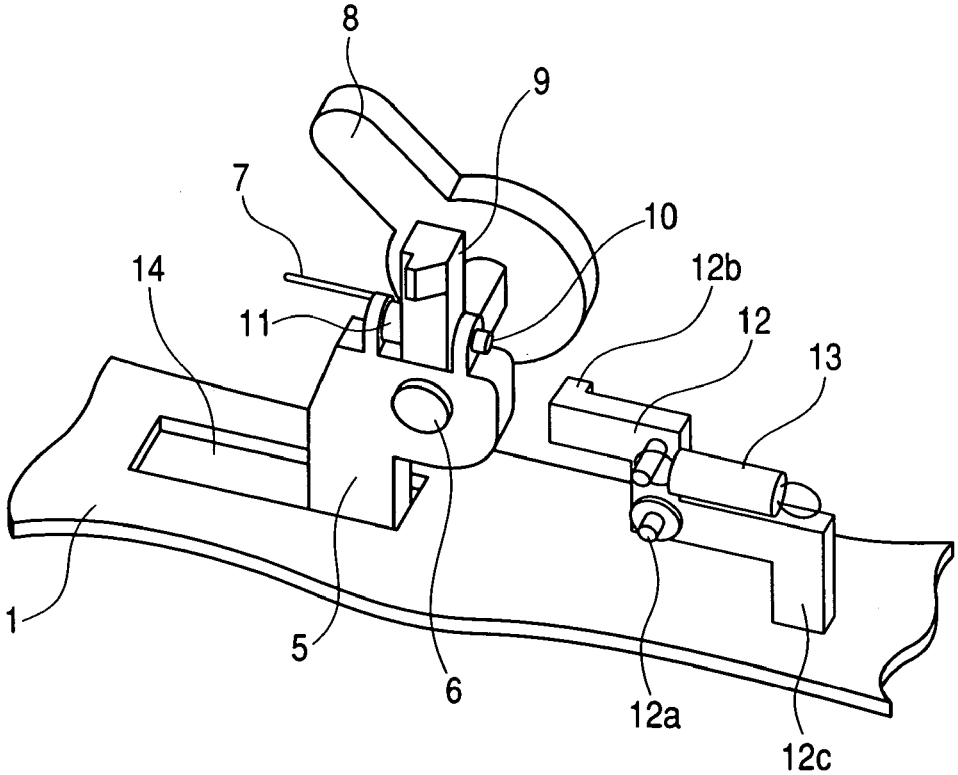
FIG. 11 is a perspective view showing another embodiment of the lock mechanism.

The work of mounting the original reading apparatus 2 on the upper portion of the image forming apparatus main body 1 is carried out by aligning the aforedescribed positioning pin 15 of the original reading apparatus 2 with and placing it in the reference hole 16 of the image forming apparatus main body 1. At this time, the inclined portion 5*c* of the latch 5 abuts against the upper surface of the abutting portion 1*c* of the image forming apparatus main body 1 and therefore, the latch 5 is once rotated in the clockwise direction as viewed in FIG. 10 against the biasing force of the torsion coil spring 7. Thereafter, the original reading apparatus 2 is placed at a desired location on the image forming apparatus main body 1 and at the same time, it is rotated in the counter-clockwise direction by the biasing force of the torsion coil spring 7, and the lock portion 5*a* of the latch 5 comes into engagement with the latch restraining hole 14. In this state, the image forming apparatus main body 1 and the original reading apparatus 2 become locked by the latch 5, thus completing the mounting of the original reading apparatus 2. FIG. 11 is a perspective view showing a state in which the original reading apparatus 2 has been mounted on the image forming apparatus main body 1 and the two apparatuses have been locked.

Figure 12:
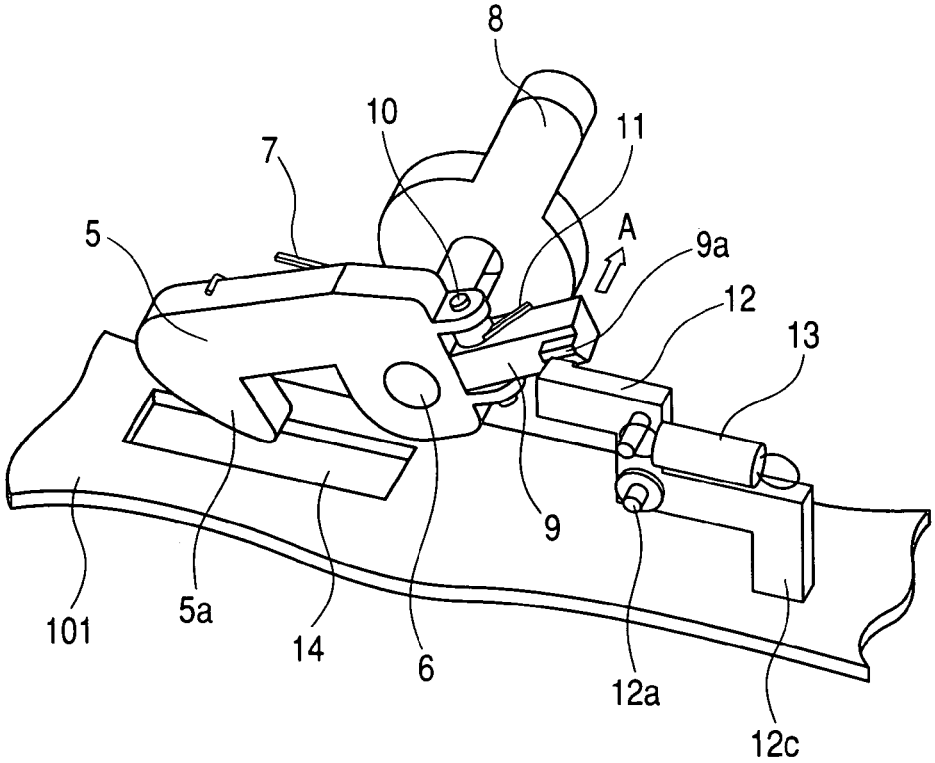
FIG. 12 is a perspective view showing another embodiment of the lock mechanism.
Figure 13:
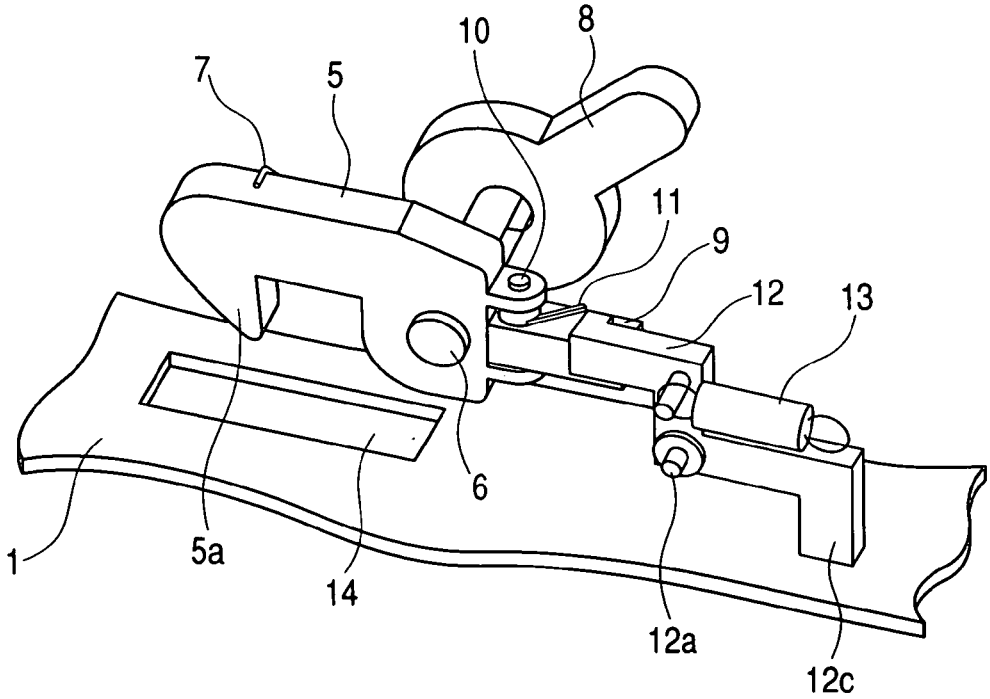
FIG. 13 is a perspective view showing another embodiment of the lock mechanism.

Reference is now had to FIGS. 12 and 13 to describe the operation of the lock mechanism 100 resulting from the operation of releasing the lock mechanism 100, and separating the apparatuses from each other.

The releasing of the lock of the image forming apparatus main body 1 and the original reading apparatus 2 is accomplished by the operator rotating the latch releasing lever 8 exposed to the outer surface of the original reading apparatus 2, and moving the latch 5 and the holder 9 to the second position shown in FIG. 13.

With the original reading apparatus 2 placed on the image forming apparatus main body 1, as previously described, the abutting lever 12 abuts against the image forming apparatus main body 1 and is in a predetermined position regulated against the spring force of the coil spring 13. In this predetermined position, the pawl 12*b* of the abutting lever 12 is in a position in which it is engageable with the projected portion 9*a* rotated to the second position.

When as shown in FIG. 12, the latch 5 is rotated with the rotation of the latch releasing lever 8 by the operator, the latch 5 is pulled out of the latch restraining hole 14 of the image forming apparatus main body 1 and the lock of the image forming apparatus main body 1 and the original reading apparatus 2 is released and the holder 9 held by the latch 5 is also rotated. When the holder 9 is rotated, the projected portion 9*a* of the holder 9 abuts against the pawl 12*b* of the abutting lever 12 which is in the predetermined position, and is rotated in the direction of arrow A in FIG. 12 about the shaft 10 against the spring force of the torsion coil spring 11. When thereafter, as shown in FIG. 13, the latch 5 is further rotated, the projected portion 9*a* provided on the holder 9 clears the pawl 12*b* of the abutting lever 12, and by the biasing force of the torsion coil spring 11, the projected portion 9*a* is returned to the position in which it is engageable with the pawl 12*b* of the abutting lever 12. Thereby, the projected portion 9*a* is restrained by the pawl 12*b*. By the projected portion 9*a* being restrained by the pawl 12*b*, the engagement between the lock portion 5*a* and the latch restraining hole 14 is released and the latch 5 is restrained in the second position wherein the image forming apparatus main body 1 and the original reading apparatus 2 are not locked and therefore, the original reading apparatus 2 becomes separable from the image forming apparatus main body 1.

Figure 14:
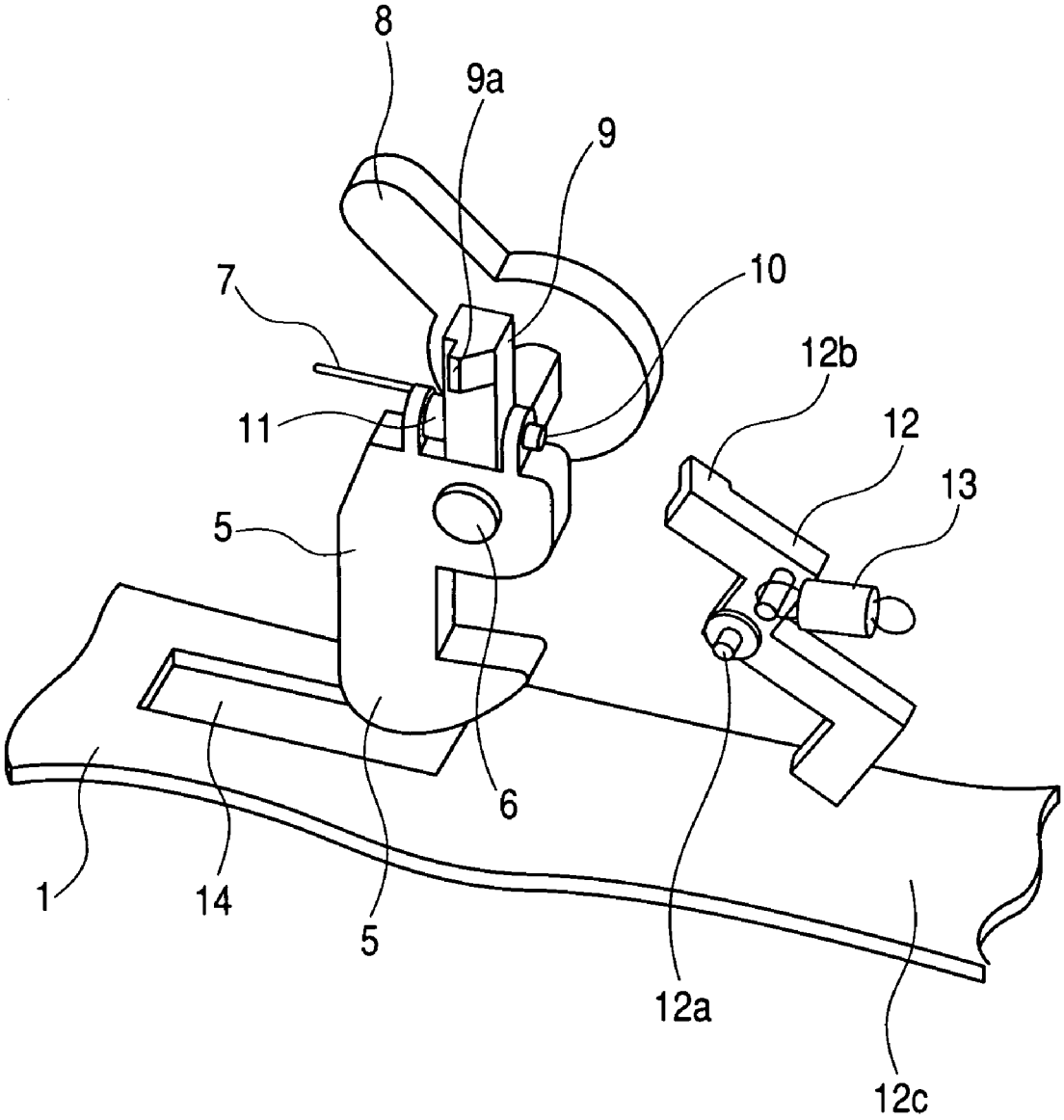
FIG. 14 is a perspective view showing another embodiment of the lock mechanism.

When in a state in which the latch releasing levers 8 on the opposite sides of the original reading apparatus 2 are operated to thereby release the lock, the original reading apparatus 2 is separated from the image forming apparatus main body 1, the latch 5 is moved to the first position in which it is possible to lock the original reading apparatus 2 and the image forming apparatus main body 1, in conformity with the operation of separating. That is, when the original reading apparatus 2 is separated from the image forming apparatus main body 1, as shown in FIG. 14, the abutting lever 12 having so far abutted against the image forming apparatus main body 1 is spaced apart from the image forming apparatus main body 1, and is rotated in the clockwise direction by the biasing force of the coil spring 13. At this time, the engagement between the pawl 12*b* of the abutting lever 12 and the projected portion 9*a* of the holder 9 is released, and the latch 5 is returned to the first position, i.e., a position in which it is possible for the lock portion 5*a* of the latch 5 to be restrained by the latch restraining hole 14 of the image forming apparatus main body 1, by the biasing force of the torsion coil spring 7.

Therefore, when the original reading apparatus 2 is to be again installed on the image forming apparatus main body 1, the two apparatuses can be reliably fixed by the same procedure as that described at first.

The latch 5 and the pawl 12*b* for restraining the latch are both provided in the original reading apparatus 2 as an option and therefore, the cost of the image forming apparatus main body 1 can be suppressed.

While a lock mechanism for locking the image forming apparatus main body and the sheet feeding apparatus has been shown by way of example as an embodiment, the lock mechanism described in the present embodiment is applicable as a mechanism for locking the two apparatuses together.

(Modification of the Other Embodiment)

A modification of the already described other embodiment will hereinafter be described with reference to FIGS. 16 and 17. The same members as those in the other embodiment are given the same reference characters, and functionally similar members need not be described.

The differences between the present modification and the already described other embodiment are that the present invention is adopted in the lock mechanism for locking the image forming apparatus main body 1 and the discharging apparatus, that the lock mechanism of the present invention is adopted to further mount and lock another discharging apparatus 3B relative to a discharging apparatus 3A mounted on the image forming apparatus main body 1, and that a plurality of latches are provided on the lock mechanism and are connected together so that the lock by the plurality of latches can be released by a single latch releasing lever.

Figure 16:
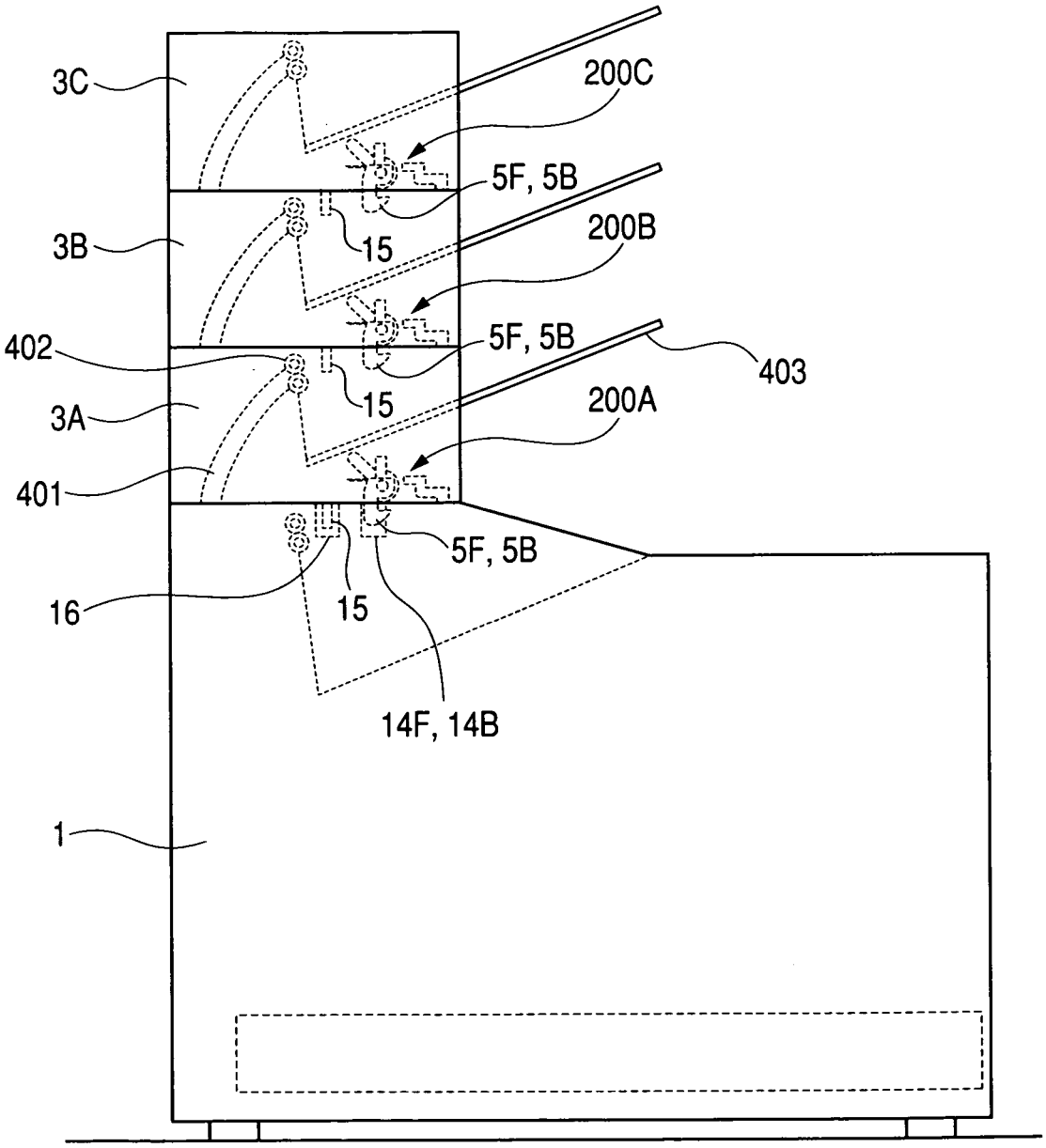
FIG. 16 is a side view showing an image forming apparatus main body and a discharging apparatus in a modification of another embodiment.
Figure 17:
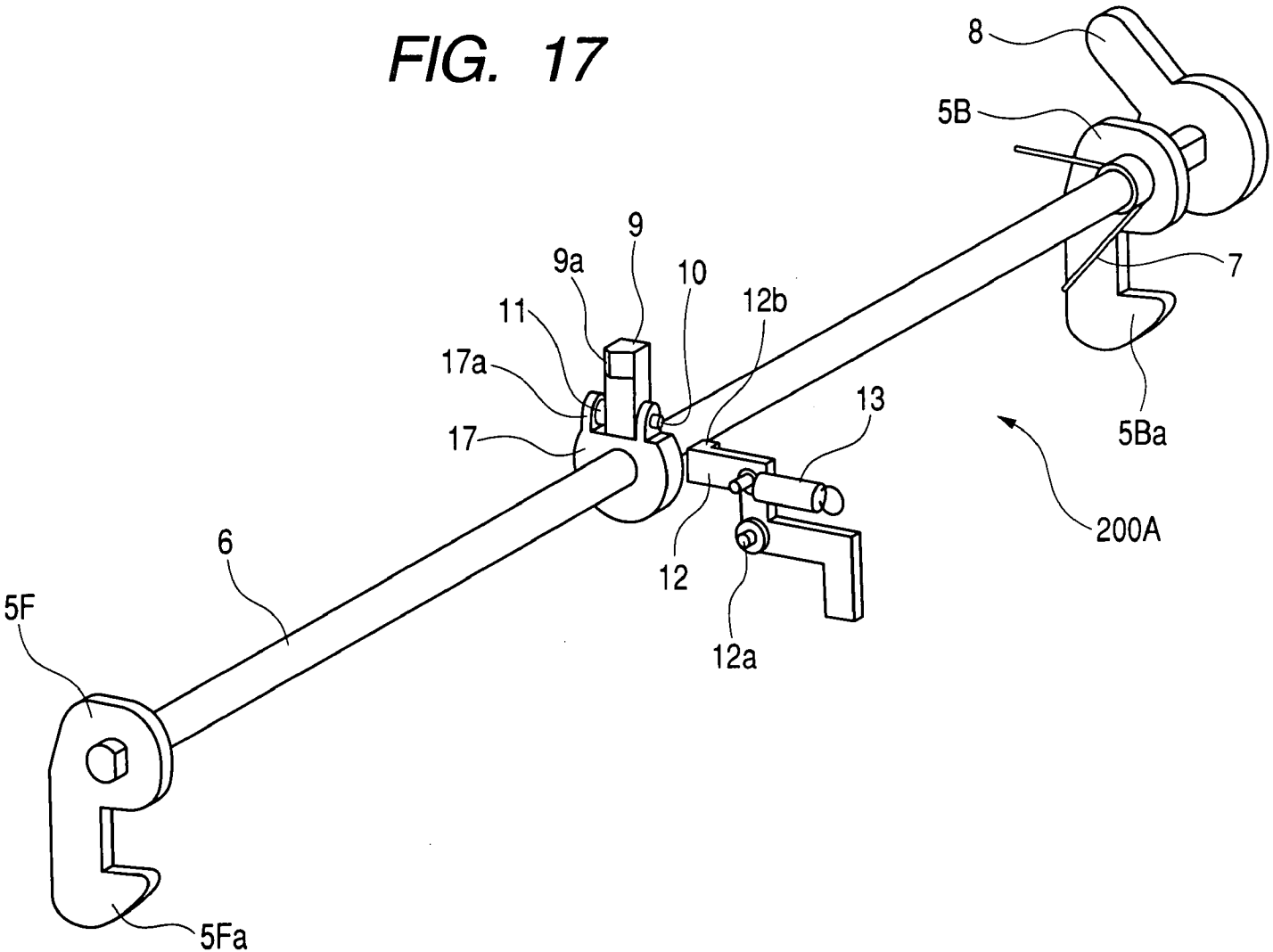
FIG. 17 is a perspective view showing a modification of another embodiment of the lock mechanism.

FIG. 16 is a side view showing an image forming apparatus main body 1 to which the present embodiment is applied and discharging apparatuses 3A, 3B and 3C. As shown in FIG. 16, a first discharging apparatus 3A is mounted on the upper portion of the image forming apparatus main body 1, and a second discharging apparatus 3B is mounted on the upper portion of the first discharging apparatus 3A. Further, a third discharging apparatus 3C is mounted on the upper portion of the second discharging apparatus 3B. Lock mechanisms 200A, 200B and 200C are provided to lock the image forming apparatus main body 1 and the first discharging apparatus 3A together, the first discharging apparatus 3A and the second discharging apparatus 3B together, and the second discharging apparatus 3B and the third discharging apparatus 3C together, respectively. The constructions of the three lock mechanisms 200A, 200B and 200C are similar to one another and therefore, only the lock mechanism 200A for locking the image forming apparatus main body 1 and the first discharging apparatus 3A together will hereinafter be described.

A positioning pin 15 is provided in the lower portion of the discharging apparatus 3A. Also, in the upper outer surface of the image forming apparatus main body 1, a reference hole 16 and latch restraining holes 14F, 14B are formed at locations substantially opposed to the positioning pin 15 and the lock portions 5F*a* and 5B*a* of latches 5B and 5F on the surface substantially opposed to the discharging apparatus.

By the above-described construction, it is possible to lock the upper and lower apparatuses together by the lock mechanism when the discharging apparatuses are mounted at a plurality of stages on the image forming apparatus main body 1.

The construction of the lock mechanism 200A will now be described with reference to FIG. 17.

A latch releasing lever 8 is fixed to one end of a latch shaft 6 rotatably held by the frame member of the discharging apparatus 3 (3A, 3B, 3C), and is exposed from the outer surface of the discharging apparatus 3. Also, in the interior and near the opposite side edges of he frame member of the discharging apparatus 3, latches 5B and 5F are fixed to the latch shaft 6. Further, a holding member 17 is fixed to the latch shaft 6 near the central portion of the frame member of the discharging apparatus 3. A holder 9 having a projected portion 9*a* is provided on the holding member 17. The holder 9 is mounted on a shaft 10 supported by the bearing 17*a* of the holding member 17. The holder 9 is held on the holding member 17 for rotation about the shaft 10 while being biased by a torsion coil spring 11.

On the other hand, on the frame member of the discharging apparatus 3 and near the holding member 17, an abutting lever 12 is held for pivotal movement about a shaft 12*a*, and is biased by a coil spring 13 and abuts against the outer surfaces of the image forming apparatus main body 1 and the discharging apparatus. Also, a torsion coil spring 7 is restrained by one latch 5B, and the latch releasing lever 8, the two latches 5F, 5B and the holding member 17 are rotatable with the latch shaft 6 and are biased by the torsion coil spring 7.

With the above-described construction, the coupling between the apparatuses becomes possible by a procedure similar to that described in the first embodiment, and when the apparatuses are to be separated from each other, it becomes possible to release the lock of the plurality of latches 5F and 5B by operating a releasing lever.

The discharging apparatus 3 is provided with a discharged sheet conveying path 401 for conveying a sheet on which an image has been formed by the image forming apparatus main body 1, and an external discharging roller 402 for discharging the sheet to an external discharging tray 403.

What is claimed is:

1. A lock mechanism for locking a first apparatus and a second apparatus, comprising:

a latch movably provided in one of said first apparatus and said second apparatus; and a pawl provided in said one apparatus, wherein said latch fits in an opening formed in the other apparatus, said pawl holds said latch at a position whereat said latch has come out of said opening, and with an operation of bringing said first apparatus and said second apparatus close to each other from a state in which said first apparatus and said second apparatus are spaced apart from each other, the holding of said latch by said pawl is released, and said latch is moved to a position in which said latch fits into said opening.

2. A lock mechanism for locking a first apparatus and a second apparatus, comprising:

a lock member movable between a first position for locking said first apparatus and said second apparatus, and a second position for not locking said first apparatus and said second apparatus;

biasing means, which biases said lock member to said first position:

a restraining portion for restraining said lock member in said second position; and a restraint releasing member, which releases the restraint of said lock member by said restraining portion, wherein with an operation of bringing said first apparatus and said second apparatus close to each other from a state in which said first apparatus and said second apparatus are spaced apart from each other, said restraint releasing member releases the restraint of said lock member by said restraining portion, and said lock member is moved from said second position to said first position by a biasing force of said biasing means.

3. A lock mechanism according to claim 2, wherein even if said first apparatus and said second apparatus are spaced apart from each other from a state in which said first apparatus and second apparatus are mounted, said restraining portion continues to restrain said lock member in said second position.

4. A lock mechanism according to claim 2, comprising a plurality of lock members, wherein said plurality of lock members are integrally moved between said first position and said second position.

5. A lock mechanism according to claim 2, wherein said lock member, said restraining portion and said restraint releasing member are provided in one of said first apparatus and said second apparatus, and with the operation of bringing said first apparatus and said second apparatus close to each other, the other apparatus and said restraint releasing member abut against each other, whereby said restraint releasing member is moved so as to release the restraint of said lock member by said restraining portion.

6. A lock mechanism according to claim 2, further comprising an operating portion operated to move said lock member from said first position to said second position.

7. A lock mechanism according to claim 2, further comprising positioning means for positioning said second apparatus at a predetermined location on said first apparatus.

8. A lock mechanism according to claim 2, wherein said first apparatus is an image forming apparatus main body for forming an image on a sheet, and said second apparatus is one of an original reading apparatus, a sheet discharging apparatus and a sheet feeding apparatus mounted on said image forming apparatus main body.

9. A lock mechanism according to claim 2, wherein said second apparatus is mounted on said first apparatus.

10. A lock mechanism according to claim 2, further comprising an operating portion operated to move said lock member from said first position to said second position, wherein said lock member which was moved to said second position by operating said operating portion is restrained by said restraining portion in said second position in a state that said first apparatus and second apparatus are mounted, wherein even if said first apparatus and said second apparatus are spaced apart from each other from a state in which said first apparatus and second apparatus are mounted, said restraining portion continues to restrain said lock member in said second position, and wherein with an operation of bringing said first apparatus and said second apparatus close to each other from a state in which said first apparatus and said second apparatus are spaced apart from each other, the restraining portion moves so as to release a restraint of said lock member.

11. An external apparatus connected to an image forming apparatus main body for forming an image on a sheet, said external apparatus comprising a lock mechanism as recited in claim 2, wherein said external apparatus is locked to said image forming apparatus main body by said lock mechanism.

12. An image forming apparatus comprising:

an image forming apparatus main body for forming an image on a sheet;

an external apparatus connected to said image forming apparatus main body; and a lock mechanism for locking said image forming apparatus main body and said external apparatus, said lock mechanism comprising:

a lock member movable between a first position for locking said image forming apparatus main body and said external apparatus and a second position for not locking said image forming apparatus main body and said external apparatus;

biasing means, which biases said lock member to said first position;

a restraining portion for restraining said lock member in said second position; and a restraint releasing member, which releases the restraint of said lock member by said restraining portion, wherein with an operation of bringing said image forming apparatus main body and said external apparatus close to each other from a state in which said image forming apparatus main body and said external apparatus are spaced apart from each other, said restraint releasing member releases the restraint of said lock member by said restraining portion, and said lock member is moved from said second position to said first position by a biasing force of said biasing means.

13. An image forming apparatus according to claim 12, comprising a plurality of lock members, wherein said plurality of lock members are integrally moved between said first position and said second position.

14. An image forming apparatus according to claim 12, wherein said lock member, said restraining portion and said restraint releasing member are provided in said external apparatus, and with the operation of bringing said image forming apparatus main body and said external apparatus close to each other from the state in which said image forming apparatus main body and said external apparatus are spaced apart from each other, said image forming apparatus main body and said restraint releasing member abut against each other, whereby said restraint releasing member is moved so as to release the restraint of said lock member by said restraining portion.

* * * * *

UNITED STATES PATENT AND TRADEMARK OFFICE

CERTIFICATE OF CORRECTION

PATENT NO. : 7,203,445 B2
APPLICATION NO. : 10/874259
DATED : April 10, 2007
INVENTOR(S) : Yasuhiro Uchida It is certified that error appears in the above-identified patent and that said Letters Patent is hereby corrected as shown below:

COLUMN 4:
Line 39, "is" should read --is a--.

COLUMN 6:
Line 1, "form" should read --from--.
Line 60, "follows the" should read --follows. The--.

Signed and Sealed this

Fourth Day of March, 2008

JON W. DUDAS
*Director of the United States Patent and Trademark Office*